US007914237B2

(12) United States Patent
Glass et al.

(10) Patent No.: US 7,914,237 B2
(45) Date of Patent: Mar. 29, 2011

(54) METHOD AND APPARATUS FOR INSERTING SHEET PILES WITHIN HIGHLY RESISTANT EARTH FORMATIONS

(75) Inventors: James O. Glass, Anahuac, TX (US); Sam M. Glass, Anahuac, TX (US)

(73) Assignee: CMI Limited Co., Atlanta, GA (US)

( * ) Notice: Subject to any disclaimer, the term of this patent is extended or adjusted under 35 U.S.C. 154(b) by 327 days.

(21) Appl. No.: 11/232,259

(22) Filed: Sep. 21, 2005

(65) Prior Publication Data

US 2007/0065235 A1 Mar. 22, 2007

(51) Int. Cl.
*E02D 7/26* (2006.01)

(52) U.S. Cl. ..... 405/274; 405/279; 405/248

(58) Field of Classification Search ..... 405/276, 405/274, 279, 248
See application file for complete search history.

(56) References Cited

U.S. PATENT DOCUMENTS

| | | | | |
|---|---|---|---|---|
| 3,889,482 | A * | 6/1975 | Frederick | 405/274 |
| 5,332,040 | A * | 7/1994 | Nahm et al. | 166/293 |
| 5,407,304 | A | 4/1995 | Glass et al. | |
| 5,443,305 | A * | 8/1995 | Heierli et al. | 299/33 |
| 5,503,503 | A | 4/1996 | Glass et al. | |
| 5,618,135 | A | 4/1997 | Glass et al. | |
| 5,803,672 | A | 9/1998 | Glass et al. | |
| 6,231,271 | B1 | 5/2001 | Glass et al. | |
| 2003/0072620 | A1 * | 4/2003 | Long | 405/248 |

* cited by examiner

*Primary Examiner* — David J Bagnell
*Assistant Examiner* — Sean Andrish
(74) *Attorney, Agent, or Firm* — Gardner Groff Greenwald & Villanueva, PC

(57) ABSTRACT

A method and apparatus for inserting a sheet pile (10) into an earth formation using a protective housing (12) releasably connected to the sheet pile (10). The protective housing has a fluid gallery and conduits for releasing fluid such as water onto the base of the sheet pile without jetting water into the earth formation. The method and apparatus are particularly suited for driving vinyl and plastic sheet piles into highly resistant soils.

19 Claims, 5 Drawing Sheets

METHOD AND APPARATUS FOR INSERTING SHEET PILES WITHIN HIGHLY RESISTANT EARTH FORMATIONS

FIELD OF THE INVENTION

This invention relates to a method and apparatus for inserting sheet piles within an earth formation using a separate protective housing or shield, and more particularly to such a method and apparatus especially suited for driving non-metallic or thin metal sheet piles into especially resistant or compacted soils or earth formations.

BACKGROUND OF THE INVENTION

Sheet piles or piling for certain uses such as seawalls, for example, may be formed of interlocking sheet piling extruded from special vinyl formulations. Vinyl sheet piles are inert to a marine environment, will not deteriorate in fresh, brackish, or salt water applications, and will not leak harmful chemicals into the water or soil. Vinyl sheet piles are also resistant to marine borers, rot, rust, galvanic corrosion, and highly acidic or alkaline soil conditions. However, vinyl sheet piles or piling, like plastic piling and other piling formed of non-metallic material or relatively thin metal material such as aluminum, is particularly vulnerable to becoming damaged when driven into an earth formation.

Sheet piling is usually driven or inserted within the soil or earth formation by drop hammers or vibratory hammers. However, certain conditions, for example low temperatures at which vinyl sheet piling tends to be brittle, contribute to the vulnerability of the piling to possible damage during the process of driving the piling into the soil. Also some soils or earth formations are particularly resistant to sheet piling and effectively refuse penetration of the piling. Continued efforts to force the piling in such highly resistant soils can result in damage to the piling. Also, certain known apparatuses and methods believed generally effective for use in installing vinyl sheet piling can be less effective in certain soils due to sticking of the soil on the apparatuses.

U.S. Pat. No. 5,503,503, issued Apr. 2, 1996, teaches a protective housing or shield that protects sheet piling during driving or insertion of the sheet piling into soil or an earth formation. The protective housing or shield is preferably formed of metal having a cross section generally similar to the cross section of the sheet pile and adapted to be releasably connected to the sheet pile for simultaneous movement with the sheet pile. The protective housing is of a length greater than the length of the sheet piling and extends beyond the upper and lower ends of the sheet piling. The protective housing and connected sheet pile are driven downward into the formation together to a desired or predetermined depth. Then, the protective housing is lifted upwardly for removal or withdrawal leaving the sheet pile in place.

That is, after insertion of the sheet pile at the desired depth in the formation, the protective housing or shield is removed by lifting of the protective housing vertically relative to the sheet pile. While generally quite effective, the protective housing and sheet pile may sometimes adhere or stick to each other, and the protective housing may be difficult to break loose or separate initially from the sheet pile. Such sticking is typically most problematic in certain clay soils.

The natural resistance of soils to penetration of piles provides desirably tight holding of piles in an earth formation. However, when soils are so resistant or so compacted as to make driving piles extremely or even prohibitively difficult, the piles, although protected by the housing provided in U.S. Pat. No. 5,503,503, may still not be driven into the earth formation to the desired depth.

Conventional methods for reducing soil resistance at the time of driving steel pipe pile into the ground have included spraying water onto the pile surface before attempting insertion of the pile or jetting water into the ground from a jet pipe attached to the central tip of the pile during pile driving.

These conventional methods, however, are not always effective, especially with non-metal and thin metal piles. An especial problem with water jetting is weakening the ground with the large quantity of uncontrolled water injected, resulting in failure of the soil to tightly hold the pile as needed. For this reason, water jetting for piling has been disapproved by the United States Army Corps of Engineers and such jetting for piling is now prohibited in many if not all areas of the United States. A need in the pile driving industry continues to exist for improved methods and apparatuses for inserting non-metal and thin metal sheet piling into highly resistant earth formations.

SUMMARY OF THE INVENTION

The present invention is directed to a method and apparatus for facilitating the driving or insertion of sheet piling in earth formations containing sticky clay or soils highly resistant to penetration, while simultaneously protecting the sheet piling from damage from the driving or insertion.

A protective housing or shield preferably formed of metal having a shape or cross section generally similar to the shape or cross section of the sheet piling is adapted to be releasably connected to the sheet piling for simultaneous movement with the sheet piling. Although the example embodiments shown in the drawings are directed to Z-shaped pilings, the invention is not limited to use with Z-shaped pilings, and may be used with any shape piling, including u-shaped piling currently gaining in popularity. This advantage of the invention is obtained by designing the protective housing to have a cross-sectional area or shape mimicking that of the sheet piling.

The housing has retaining members adjacent its lower end for releasably connecting the sheet piling to the housing for movement therewith. At least some of the retaining members are mounted for movement between engaged and disengaged positions relative to the sheet piling. The housing is of a length greater than the length of the sheet piling and a generally horizontal force exerting member on the housing extends over the upper end of the sheet piling when the sheet piling and housing are connected for exerting a driving force against the upper end of the piling from a vibratory hammer or drop hammer on the housing.

A fluid container or gallery extends at least partially across the protective housing and connects or joins to fluid conduits or legs running down the side(s) of the housing and extending lengthwise to (or near) the bottom of the housing. The fluid gallery is positioned at or near the top of the protective housing but below and out of the way of the generally horizontal force exerting member on the housing. The fluid gallery should be large enough to contain sufficient fluid to form a fluid head in the gallery before the fluid proceeds down the fluid conduits.

The number of conduits extending down the side(s) of the of the protective housing generally depends on the size of the sheet piling—the bigger the sheet piling, and consequently the bigger the protective housing for the sheet piling, the more conduits needed. Preferably, at least a pair of conduits is used. For example, for a typical sheet piling of two connected Z-shaped sheets (each about 12 to 18 inches in width), a pair of conduits, one on a side of the housing approximately midway the position of each Z-shaped sheet behind the housing, or effectively one on each side of the housing overall, is generally or typically sufficient. For another example, for a sheet piling of three or four connected Z-shaped sheets, about three or four conduits would generally or typically be sufficient. Similarly, two or three conduits would typically be sufficient for a U-shaped sheet, about 30 inches in width. At least three, and more preferably four to six, conduits might be desirable for a modified Z-U-shaped sheet about 50 inches in width.

At least one orifice or hole in each of the fluid conduits, preferably located near the bottom of the conduits and the protective housing, allows fluids in the conduits to exit or be discharged from the conduits to the inside of the protective housing, adjacent to the bottom of the sheet piling, and onto the sheet piling. If at least a portion of the protective housing is between the conduit and the sheet piling as may typically occur when the conduit is connected to the protective housing rather than formed into or built within the housing, the orifice extends from the side of the conduit adjacent the housing, through the protective housing, so that the fluid flows out of the conduit onto the sheet piling. The orifices should be located such that the fluid discharges from the conduits and onto the sheet piling preferably in a horizontal plane, and preferably fully wetting or covering the bottom of the sheet piling. The fluid does not jet into the soil, and each conduit and orifice is positioned so that jetting of the fluid into the soil does not occur, even when the fluid is at high pressure.

The fluid does not have to be under pressure in flowing through the fluid gallery and down the conduits onto the sheet piling, although pressures as great as at least about 100 psi may effectively be used. The fluid gallery has a pipe fitting or other connection or connector to a fluid source, such as, for example, a pipe or high pressure hose leading into a fluid supply, such as a pump and/or a fluid reservoir. Such connector, preferably adjustable or openable and closeable, allows fluid to flow from the fluid source into a fluid gallery from whence the fluid flows into the conduits (or conduit legs) and ultimately out the orifices at the base of the conduits. The fluid may be water or a synthetic fluid particularly suited for aiding penetration of the pile into the earth formation. Alternatively, the fluid may be air. Embodiments employing air rather than a liquid fluid may be suitably used in soils or earth formations containing water positioned such that the air will contact the water during the driving of the sheet piling.

The housing and sheet piling protected by the housing are driven downwardly into the soil together to a desired depth. Preferably fluid is caused to flow through the fluid conduits during this pile driving, and the fluid flow may be begun at the beginning of the pile driving or at some point when undue soil resistance is met (or expected to be met) during the pile driving. The fluid flow may be continued throughout the driving and stopped at the desired depth or stopped at some point earlier. Once the desired depth is reached, the housing is lifted upwardly for removal leaving the sheet piling in place.

The protective housing or shield for the sheet piling, particularly sheet piling formed of a rigid vinyl or plastic material, minimizes damage to the sheet piling during installation, and when combined with the fluid permits the sheet piling to be easily driven to a desired depth even with large drop hammers or vibratory hammers and even in highly resistant or sticky clay earth formations. The flow of fluid through the conduit is typically manually activated although such activation may optionally be associated with the activation of the movement of the housing, turning on or allowing fluid flow when the housing is engaged and turning off or ceasing flow when the housing is disengaged, for one non-limiting example.

Other features and advantages of this invention will become more apparent after referring to the following specification and drawings.

DETAILED DESCRIPTION OF THE PREFERRED EMBODIMENTS

Figure 1:
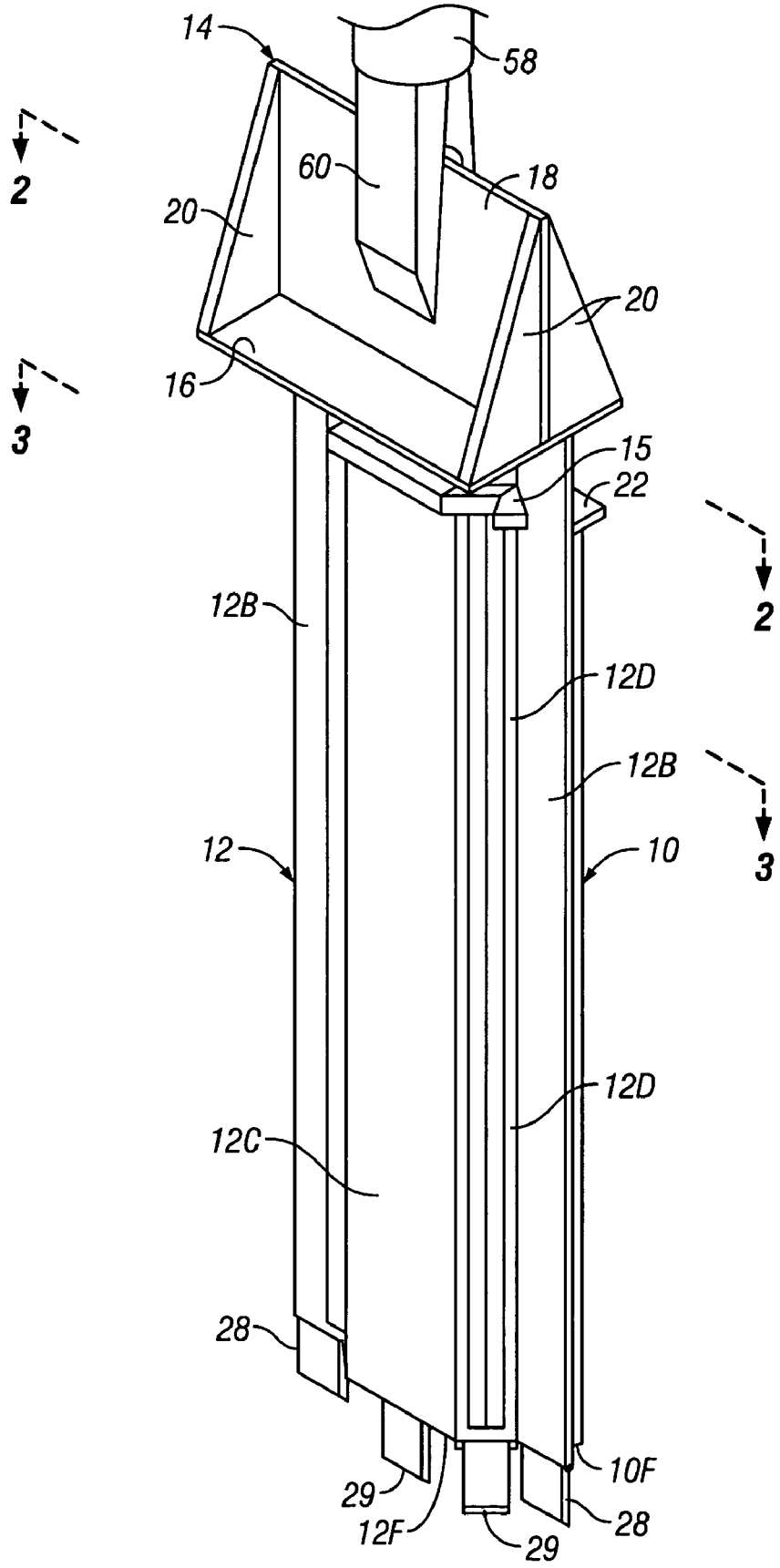
FIG. 1 is a perspective view of one embodiment of the invention showing sheet piling retained by an outer protective housing for movement with the protective housing, and showing a fluid gallery across the top and fluid conduits down sides of the housing.

In a preferred embodiment, the present invention is an adaptation or modification of the apparatus shown and described in U.S. Pat. No. 5,503,503. That is, the apparatus of that patent is adapted to include the fluid gallery and fluid conduits and orifices described herein. Thus, the description set forth in U.S. Pat. No. 5,503,503 is background to the present invention and that patent is incorporated in its entirety herein by reference.

Referring now to the embodiment of the invention shown in FIGS. 1-5, a sheet pile or piling is generally at 10. Sheet pile 10 is illustrated as a pair of Z-shaped pile sections which have been previously secured to each other at an interfitting tongue and groove joint 10A. Sheet pile 10 includes side flanges 10B, central body portion 10C, integral connecting portions 10D, tipper end 10E, and a lower end 10F. Sheet pile 10 is formed of a rigid plastic or synthetic material such as a rigid vinyl material. A protective housing or shield, generally indicated at 12, and preferably comprised of metal, is provided for protecting the sheet pile 10 during pile driving. The protective housing 12 is thus releasably connected to pile 10 for being driven with pile 10 into the soil or an earth formation.

Protective housing 12 has a shape or cross section generally similar to the shape or cross section of pile 10, including side flanges 12B, central body portion 12C, integral connecting portions 12D, and lower end 12F. Protective housing 12 is of a length greater than the length of sheet piling 10 and extends substantially beyond ends 10E and 10F and sheet piling 10.

Fluid gallery 11—an expanded fluid container/conduit—extends at least partially across the upper or top end of housing 12 and joins or connects to fluid conduits or legs 11A and 11B, which are preferably attached to the housing 12. The size of the fluid gallery 11 should be sufficient to contain enough fluid to form a head prior to flow of the fluid down the conduits 11A and 11B and yet not so large as to become cumbersome or to interfere with the pile driving.

The fluid conduits 11A and 11B extend down the side(s) of housing 12, for example running along or down the integral connecting portions 12D of the housing 12, preferably the length of the housing 12 or at least the length of the sheet piling 10. That is, most preferably, the fluid conduits 11A and 11B extend to or even beyond end 10F of sheet piling 10. At least one orifice 13A in fluid conduit 11A and at least one orifice 13B in fluid conduit 11B are positioned so that fluid will be discharged from the conduits 11A and 11B only to the interior or back side of housing 12 adjacent to sheet piling 10 and not to the exterior or front side of the housing 12. The positioning of conduits 11A and 11B with respect to each other and the positioning of orifices 13A and 13B with respect to each other and with respect to the conduits 11A and 11B should preferably be such that fluid exiting from the conduits 11A and 11B is discharged onto the sheet piling 10, most preferably in a horizontal plane, at the bottom or lower end 10F of the sheet piling 10. Most preferably, the discharged fluid will entirely cover the lower end 10F of the sheet piling 10. If the conduits 11A and 11B are separate from the housing 12 rather than built into housing 12 or an integral part of housing 12, such that a portion of housing 12 lies between the conduits 11A and 11B and the sheet piling 10, then the orifices 13A and 13B must extend through that portion of the housing 12 to open into the interior side of the housing 12 adjacent the sheet 10, as particularly shown in FIG. 4. Further, the conducts 11A and 11B and orifices 13A and 13B must be positioned so that fluid does not jet into the soil during pile driving or when the fluid is discharging onto the sheet piling 10.

Preferably, the fluid gallery 11 and the conduits 11A and 11B are comprised of the same material or metal or a compatible material or metal as the material or metal comprising the housing 12 and preferably are welded to the housing 12. Similarly, and preferably, each conduit 11A and 11B is welded to the gallery 11 so that leakage of fluid flowing from the gallery into the conduits can be easily avoided. Alternatively to welding, fittings with "0" rings could be used.

Figure 5:
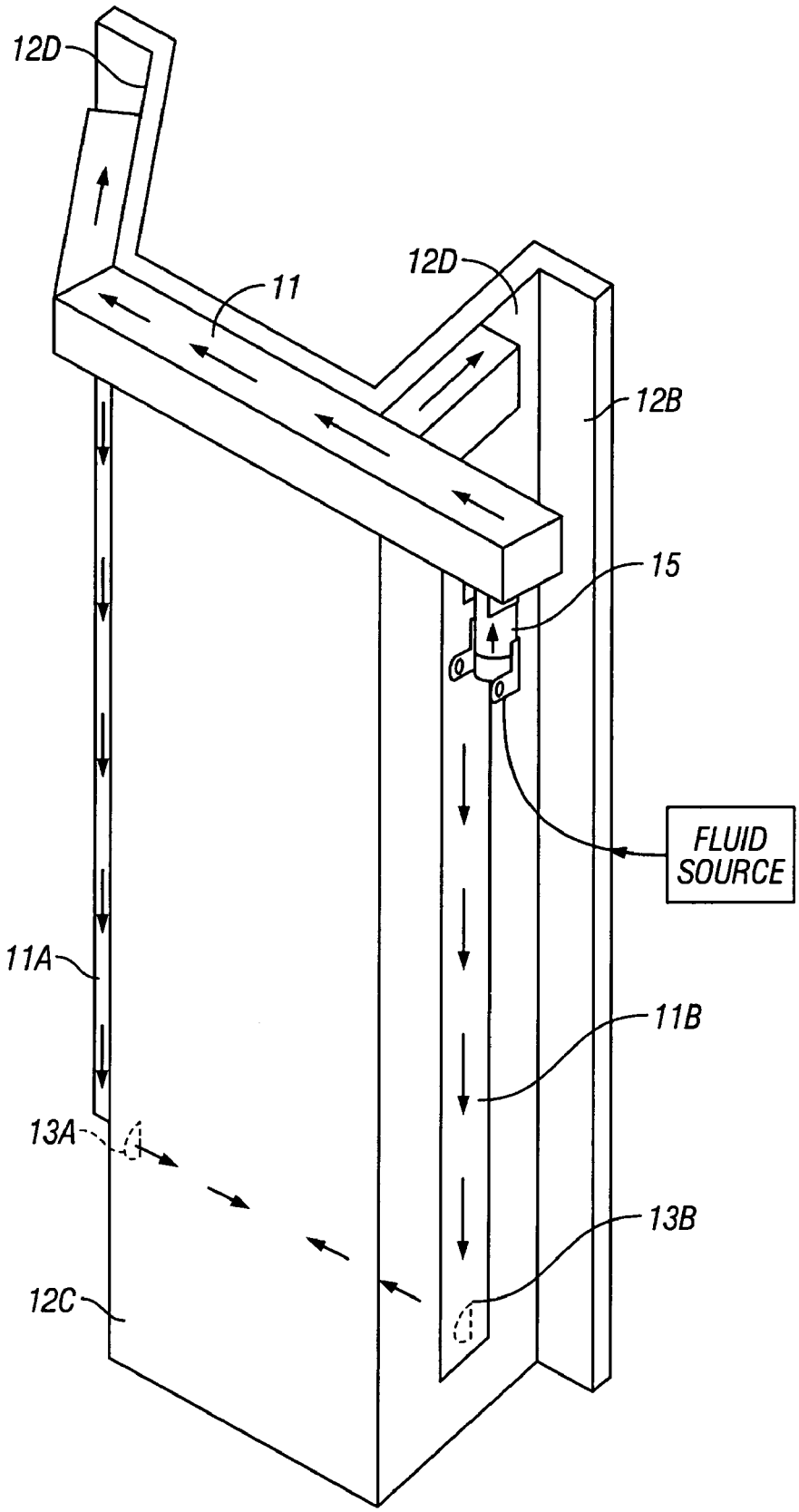
FIG. 5 is a schematic showing the direction of fluid flow from the fluid source through the fluid connector to the fluid gallery and fluid conduits on the protective housing of the embodiment of the invention of FIG. 1.
Figure 6:
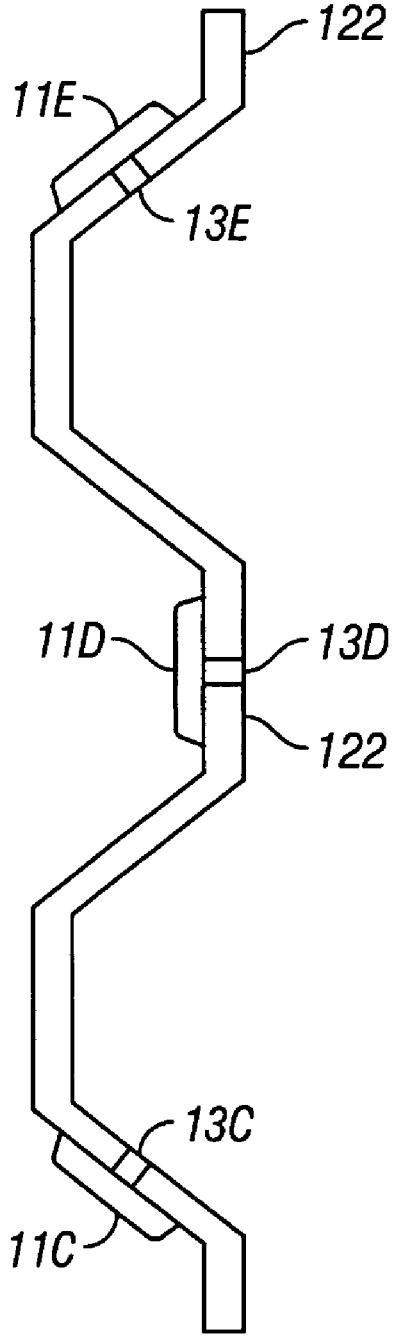
FIG. 6 is a sectional view showing a perspective of a portion of the protective housing with fluid conduits on the housing of another embodiment of the invention.

Although a pair of conduits 11A and 11B with a pair of orifices 13A and 13B respectively are shown for example in FIGS. 1-5, an alternative example embodiment could include three conduits, 11C, 11D, 11E, on housing 122 and three orifices, 13C, 13D, 13E, in the conduit and through the housing as shown in FIG. 6. In still another embodiment, four or more conduits and four or more orifices might be used. The number of conduits extending down the side(s) of the of the protective housing 12 generally depends on the size of the sheet piling—the bigger the sheet piling 10, and consequently the bigger the protective housing 12 for the sheet piling 10, the more conduits needed. Preferably, at least a pair of conduits is used. For example, for a typical sheet piling of two connected Z-shaped sheets (each about 12 to about 18 inches in width), a pair of conduits, one on a side of the housing approximately midway the position of each Z-shaped sheet behind the housing, or effectively one on each side of the housing overall, may be generally or typically sufficient. For another example, for a sheet piling of three or four connected Z-shaped sheets, about three or four conduits may be generally or typically sufficient. Similarly, two or three conduits may be sufficient for a U-shaped sheet, about 30 inches in width. At least three, and more preferably four to six, conduits might be desirable for a modified Z-U-shaped sheet about 50 inches in width.

Figure 2:
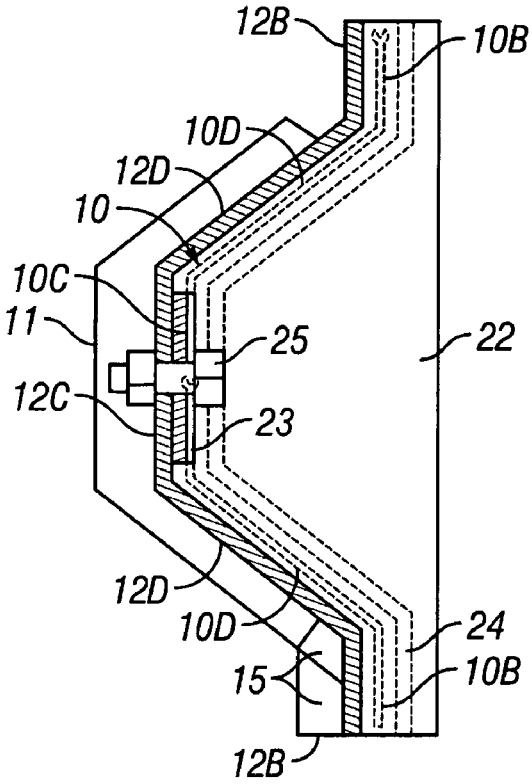
FIG. 2 is a sectional view taken generally along line 2-2 of FIG. 1 showing a perspective of the upper end portion of the connected sheet piling and the protective housing, showing the top of the fluid gallery and connection of the fluid gallery to a connector (to a fluid source not shown), and showing a force exerting member on the housing extending over the upper end of the sheet piling for transferring a driving force to the upper edge of the sheet piling.
Figure 3:
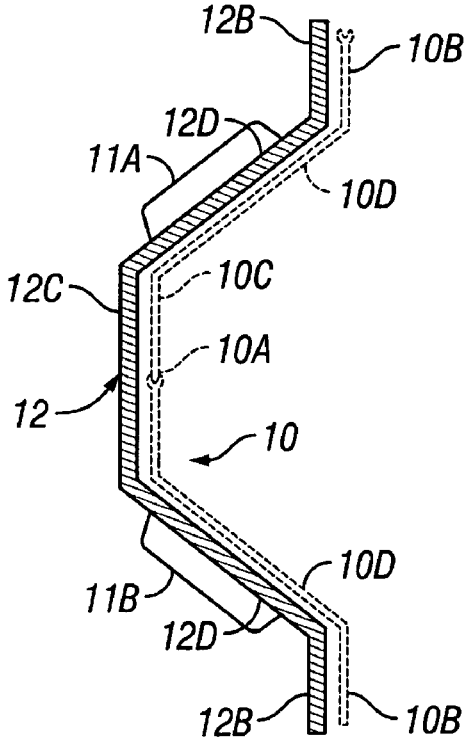
FIG. 3 is a sectional view taken generally along line 3-3 of FIG. 1 showing a perspective of a portion of the connected sheet piling and the protective housing and showing fluid conduits on said housing.
Figure 4:
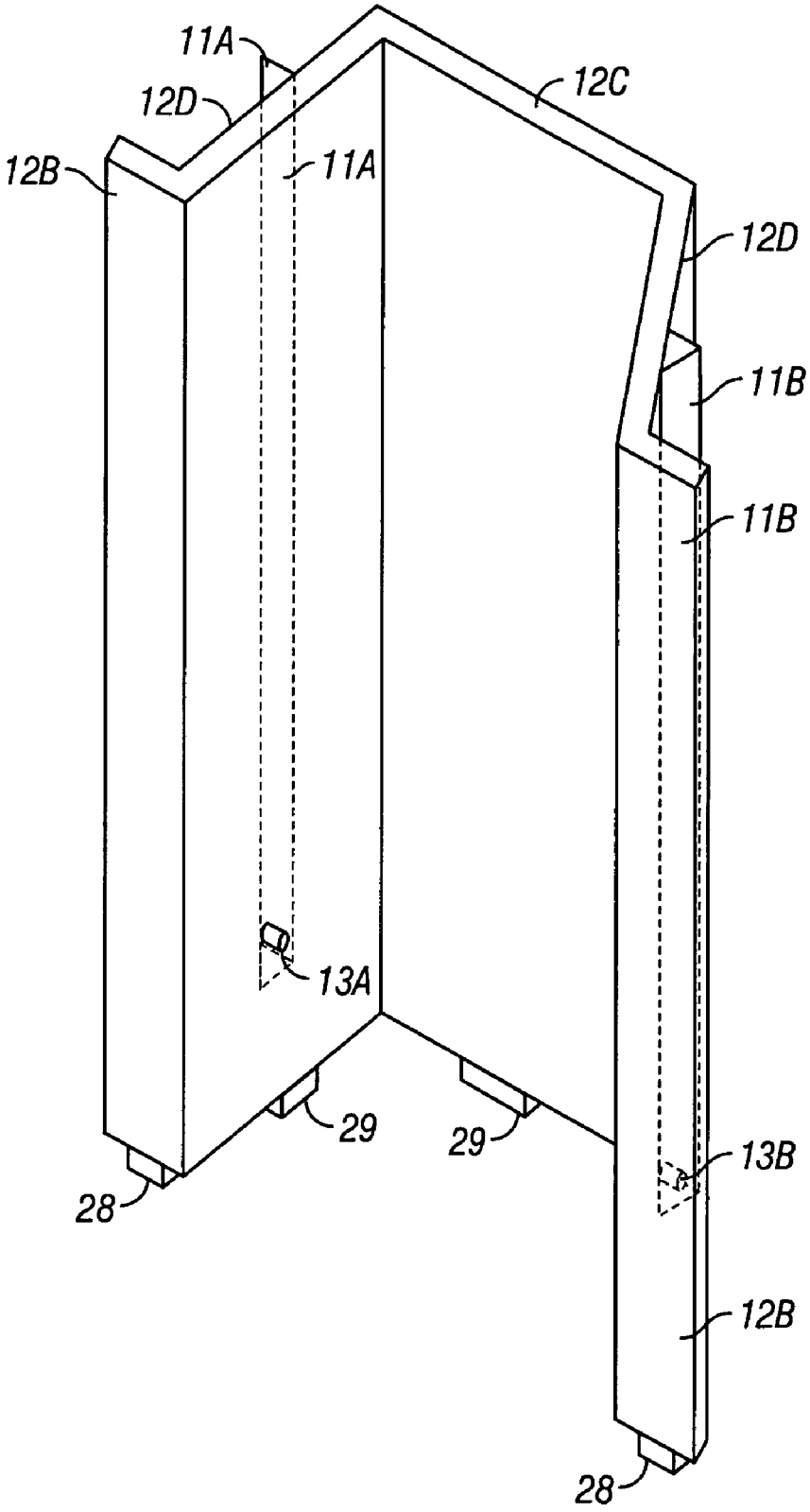
FIG. 4 is an enlarged back perspective view of the lower portion of the protective housing of FIG. 1 showing the orifices in the fluid conduit through which fluid is discharged onto the sheet piling when it is behind the protective housing.

Referring to FIGS. 1, 2 and 5, a connector 15 connects fluid gallery 11 directly or indirectly to a fluid source (not shown) which may be a fluid reservoir or a fluid or high pressure pump which itself may be connected to or associated with a fluid reservoir. The fluid may be water or other fluid suited for facilitating or aiding penetration of the sheet piling 10 into the earth formation. Alternatively, the fluid may be air. Air is effective as a fluid for use in the present invention when the earth formation contains water, and the pile will be driven through such water while air is flowing onto the pile.

Secured to the upper end 12E of housing 12 is an upper support bracket generally indicated at 14 including a lower horizontal base 16 and a vertical support plate 18. End reinforcing braces 20 are secured between base 16 and vertical support plate 18. Secured to housing 12 below upper support bracket 14 is a horizontal force exerting plate 22 adapted to extend over and contact upper end 10E of piling 10 when piling 10 and protective housing 12 are connected together. A downwardly extending retaining lip or extension 24 on force exerting plate 22 extends outwardly of and adjacent sheet piling 10 when releasably connected to protective housing 12 to block outward lateral movement of sheet piling 10 away from housing 12. Lip 23 is of a shape generally similar to the cross sectional shape of sheet piling 10. A hanger plate 23 secured to force exerting plate 22 is bolted at 25 to housing 12. Fluid gallery 11 is generally positioned below base plate 16 and is preferably below the force exerting plate 22, but on the other side of the housing 12.

Mounted on housing 12 adjacent lower end 12F are a plurality of retaining members or flaps including generally similar retaining flaps 28 mounted on flanges 12B and generally similar retaining flaps 29 mounted on central body portion 12C and connecting portions 12D as shown in FIG. 1.

In operation, housing 12 is first positioned adjacent sheet pile 10 with the upper end 10E contacting force exerting plate 22 adjacent retaining lip 24, and the lower end 10F of sheet pile 10 above flaps 28. A crane or the like positions housing 12 adjacent sheet pile 10 and pivot retainer flaps 28 are caused to move inwardly about the lower end portion of sheet pile 10 to hold pile 10 in releasably connected position with protective housing 12.

Upon connection of housing 12 and sheet piling 10 with flaps 28 engaging piling 10, the connected piling 10 and protective housing 12 are transported in vertical relation by a suitable crane or the like to the desired location where sheet piling 10 is to be embedded within the soil or earth formation. The connected sheet piling 10 and protective housing 12 are then lowered to the point or position at which it is desired to drive sheet piling 10 into the formation. A vibrator hammer generally indicated at 58 is secured by suitable clamps or jaws 60 to support plate 18 and is connected to a suitable source of power. Fluid connector 15 is connected to a fluid source. Vibrator hammer 58 is then energized and fluid is caused to flow through connector 15 into fluid gallery 11. Connected sheet piling 10 and protective housing 12 move downwardly within the formation as a result of a driving force exerted by vibrator hammer 58 and force exerting plate 22 against the upper end 10E of piling 10, as fluid flows into the fluid gallery and from the fluid gallery 11 down the fluid conduits 11A and 11B, out the orifices 13A and 13B, and onto the base 10F of the piling 10. The fluid preferably covers the entire base of piling 10. Contact with the adjacent soil will maintain retaining flaps 28 in retaining relation with sheet piling 10 as piling 10 and housing 12 are driven downwardly. Flaps 29 upon engagement with the formation are pivoted inwardly of housing 12 as piling 10 moves downwardly for engaging sheet piling 10 in the same manner as retaining flaps 28. Thus, retaining lip 24 and retaining flaps 28 and 29 releasably connect sheet piling 10 to housing 12 for being driven downwardly together. When the connected sheet piling 10 and protective housing 12 reach the desired depth for sheet piling 10, flow of fluid into fluid gallery 11 is stopped (preferably by stopping the flow of fluid into and through connector 15 from the fluid source) and housing 12 is lifted upwardly by a suitable crane or the like and flaps 28, 29 are pivoted downwardly upon engagement with the formation to a vertical relation as shown in FIG. 1 to permit removal of protective housing 12 from sheet piling 10 leaving piling 10 in place.

Alternatively, if penetration of sheet piling 10 into the earth formation is proceeding easily or at a satisfactory rate, the flow of fluid into conduit 11 may be stopped before the desired depth of the sheet piling 10 is reached. In still another embodiment, the fluid connector 15 may not be connected to a fluid source until significant or undue soil resistance is encountered during the pile driving and at that time fluid may be caused to flow through the connector 15 into the fluid gallery 11 and then down the conduits 11A and 11B, through the orifices 13A and 13B, and onto the base 10F of piling 10.

Another embodiment is especially adapted for use with a drop hammer. In that embodiment, the drop hammer exerts a force against the force exerting plate in the same manner as the embodiment of FIG. 1 for driving sheet pile 10 downwardly. The fluid gallery 11 is positioned below the force exerting plate and is connected to fluid conduits in a similar manner as in the embodiment of FIG. 1. Fluid is caused to flow through the fluid gallery preferably from the time the sheet installation begins until the desired depth is reached or until soil penetration is sufficiently easy without the fluid, as in other embodiments.

From the above, it is apparent that an improved method and apparatus has been provided for facilitating the insertion of plastic or vinyl sheet piling or relatively thin metal sheet piling into especially resistant soils or earth formations while maintaining protection of the sheet piling as it is driven into the soils or earth formations. The protective housing is first initially connected to the sheet piling and then the connected sheet piling and protective housing are driven downwardly together in the formation to the desired depth. During this driving, fluid flows into a fluid gallery on the protective housing where it typically builds head and flows through one or more fluid conduits on or of the protective housing, and is released or discharged onto the base of the sheet piling, preferably in a horizontal plane. The fluid may be but is not necessarily released at high pressure. When the sheet piling reaches the desired depth in the formation, the protective housing is lifted upwardly without any further actuation and the fluid flow into and through the fluid gallery and conduit(s) is stopped. Alternatively, the fluid flow into the conduit may be stopped after entry of the sheet piling into the earth formation but before the sheet piling has reached the desired depth.

Generally, the advantages of the invention are particularly appreciated when the earth formation has stiff soils that would refuse the piling without the invention. That is, the advantages of the invention are particularly appreciated when, without the invention, a vibratory hammer would have to strike about 35 to 40 blows per foot to effect insertion of the piling or when the piling could not penetrate the soils at all. Under such conditions, the invention will reduce the "resistance" or blow count ranging from about 35 to 40 blows to a blow count of about 25 blows or less.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. Apparatus for assisting the insertion of a sheet pile to a desired depth within an earth formation having soils highly resistant to penetration, comprising:

an outer protective housing of a shape generally similar to a shape of the sheet pile and adapted to be positioned in a vertical position adjacent one side of said sheet pile for releasable connection to said sheet pile; said protective housing extending vertically above said sheet pile and having a generally horizontally extending force exerting member adapted to extend over an upper end of said sheet pile for contacting the upper end of said pile in a driving relation; and said protective housing extending vertically below said sheet pile; and means on a lower end of said housing below said sheet pile for releasably engaging a lower end of said sheet pile for lifting of said pile and permitting removal of said protective housing from the earth formation and said sheet pile after insertion of said sheet pile;

force exerting member attached to said housing for exerting a downwardly directed driving force against said protective housing and thence against the upper end of said sheet pile through said force exerting member for insertion of said sheet pile within the earth formation;

a fluid gallery having a fluid source or a connector to a fluid source;

at least two fluid conduits connected to said fluid gallery and extending approximately a length of said sheet pile or said housing, each said conduit having at least one orifice positioned such that fluid exits each said conduit onto said sheet pile without jetting into the soil;

wherein said fluid conduits can accommodate fluids having pressure of up to about 100 psi; and wherein said fluid source or said connector to said fluid source is controllable such that fluid flow into the fluid gallery, through the conduits, and onto the sheet pile, has a pressure of less than about 100 psi, and is started upon initial insertion of the sheet pile into the resistant soils and said fluid flow continues until the pile reaches the desired depth and the protective housing is removed.

2. Apparatus as set forth in claim 1 wherein each said orifice is positioned such that the fluid exits the fluid conduits in a horizontal plane.

3. Apparatus as set forth in claim 1 wherein each said orifice is positioned such that the fluid exits the fluid conduits onto a base of the sheet pile.

4. Apparatus as set forth in claim 1 wherein said housing is formed of metal and said pile is formed of a rigid plastic or vinyl material.

5. Apparatus as set forth in claim 4 wherein said fluid gallery is formed of metal.

6. Apparatus as set forth in claim 4 wherein said fluid conduits are formed of metal.

7. A method for inserting a sheet pile to a desired depth within an earth formation comprising the following steps:

providing a protective housing of a shape generally similar to a shape of the sheet pile and of a length greater than a length of the sheet pile;

providing a force exerting member on the housing for exerting a force against an upper end of the sheet pile;

providing at least one fluid conduct on the housing, a source of fluid to each said conduit, and at least one orifice in the conduit for discharge of fluid from the conduit to side of the housing at or near a base of the sheet pile without jetting into the earth formation;

providing releasable pile retaining means on the housing for releasably retaining the sheet pile adjacent the housing during insertion of the sheet pile within the earth formation;

positioning the housing adjacent one side of the sheet pile;

positioning the pile retaining means adjacent the sheet pile and releasably connecting the sheet pile and the protective housing together;

moving the connected sheet pile and protective housing in a vertical relation to a location at which said sheet pile is to be inserted within the earth formation;

applying force against the protective housing, while causing the fluid to flow continuously through each said conduit and be discharged continuously onto the base of the sheet pile without jetting into the earth formation, for moving the protective housing and the sheet pile vertically downwardly into the earth formation to the desired depth; and lifting the protective housing upwardly relative to the sheet pile for removal of the protective housing from the earth formation leaving the sheet pile in place within the earth formation;

wherein the flow of fluid through each said conduit has a pressure of less than about 100 psi, and is not stopped until the sheet pile reaches the desired depth in the formation and the protective housing is removed from said sheet pile.

8. The method as set forth in claim 7 wherein the fluid is water.

9. The method as set forth in claim 7 wherein the fluid is a synthetic fluid that facilitates penetration of said sheet piling into the earth formation.

10. The method as set forth in claim 7 wherein the fluid is air and wherein the earth formation contains water positioned such that the air will contact the water during the moving of the protective housing and sheet pile vertically downwardly into the earth formation.

11. The method as set forth in claim 7 wherein the fluid conduit comprises a fluid gallery located beneath the force exerting member and at least two conduit legs extending down sides of the housing to the base of the sheet piling.

12. The method as set forth in claim 11 wherein the fluid builds up a head in said gallery prior to flowing down the conduit legs and out each said orifices onto the sheet piling.

13. The method as set forth in claim 7 including the step of:

applying force against the protective housing from a vibrator hammer attached to said protective housing.

14. The method as set forth in claim 7 including the step of:

applying force against the protective housing from a fluid actuated drop hammer contacting said housing.

15. The method of claim 7 wherein said fluid flow is associated with connection of the sheet pile and the protective housing, such that the fluid flow begins when the sheet pile and the protective housing are releasably connected together and the fluid flow stops when the protective housing is removed from the sheet pile.

16. The method of claim 7 wherein the sheet pile is comprised of a synthetic vinyl or plastic.

17. A method for inserting a sheet pile into an earth formation having soils highly resistant to penetration, said method comprising the following steps:

employing a protective housing for said sheet pile wherein said protective housing comprises a fluid gallery connected to at least two fluid conduits each said conduit each said conduit having at least one of said orifices positioned such that fluid can flow out of the orifices and onto a base of the sheet pile without jetting into the earth formation;

connecting said fluid gallery to a fluid source; and causing the fluid to flow continuously through said gallery and each said conduit, out each said orifice, and onto the base of the sheet pile without jetting fluid into the earth formation during insertion of said sheet pile into the earth formation through said soils highly resistant to penetration; and removing the protective housing after said insertion of said sheet pile.

18. The method of claim 17 wherein said fluid flows onto said sheet pile in a horizontal plane.

19. The method of claim 17 wherein said fluid comprises water.

* * * * *